United States Patent [19]

Tarroux

[11] Patent Number: 4,665,346

[45] Date of Patent: May 12, 1987

[54] STARTING CONTROL CIRCUIT FOR A HIGH PRESSURE LAMP

[75] Inventor: Pierre Tarroux, Paris, France

[73] Assignee: Europhane, Paris, France

[21] Appl. No.: 812,933

[22] Filed: Dec. 23, 1985

[51] Int. Cl.[4] ..... H05B 37/00

[52] U.S. Cl. ..... 315/289; 315/290; 315/DIG. 2; 315/DIG. 7

[58] Field of Search ..... 315/DIG. 2, DIG. 7, 315/290, 289

[56] References Cited

U.S. PATENT DOCUMENTS 4,378,514 3/1983 Collins ..... 315/290

*Primary Examiner*—Harold Dixon

*Attorney, Agent, or Firm*—Lowe Price LeBlanc Becker & Shur

[57] ABSTRACT

The operation of the starting circuit is only allowed for a predetermined time period in response to a control signal which is generated either following the application of the alternating voltage to the input terminals of the lamp circuit at the beginning of a working period of the lighting installation including said lamp, or a predetermined delay after interruption of said alternating voltage due to a short power interruption. The operation of the starting circuit is not allowed if the lamp extinguishes due to an increase of its voltage, thus avoiding attempts to re-start a defective lamp.

4 Claims, 8 Drawing Figures

STARTING CONTROL CIRCUIT FOR A HIGH PRESSURE LAMP

BACKGROUND OF THE INVENTION

The present invention relates to a starting control circuit for a high pressure lamp.

In public lighting installations, high pressure (HP) lamps, in particular HP sodium lamps are commonly used which are individually controlled by means of a photocell mounted on the lantern itself.

As such a lamp approaches the end of its life, the necessary voltage to be applied to the lamp to keep it working increases from its nominal value to a higher value, for example from 110 V to 130–140 V. In addition, the arc voltage becomes higher when the temperature of the lamp increases so that the working threshold voltage may exceed a value above which the lamp extinguishes. However, as the lamps thereafter cools, it may be started again because the starting circuit continuously provides starting pulses and the above threshold voltage decreases due to the decrease of temperature. This can be repeated during the whole working period of the lighting installation and is known as the "cycling" phenomenon.

Such defective lamps cause an actual discomfort and are not easily detected despite regular inspection of the public lighting installations due to their intermittent working.

OBJECTS AND SUMMARY OF THE INVENTION

It is an object of the invention to avoid the "cycling" phenomenon of defective lamps so as to allow the detection of such lamps and to render the inspection of public lighting installations more effective.

It is also an object of the invention to allow existing public lighting installations to be provided with "anti-cycling" devices with the least possible modification of the lamp circuits.

These and other objects are attained according to the invention by providing a high pressure lamp circuit having input terminals for connection to a source of alternating voltage, output terminals for connection to a lamp, ballast means between the input and output terminals and a starting circuit, with a starting control circuit comprising:

memory means having a first state or a second state and connected to said input terminals to be changed from said second state to said first state in response to the application of said alternating voltage at said input terminals and to remain in said first state during a predetermined time period after interruption of said alternating voltage at the input terminals, before returning to said second state;

controllable switch means connected to said starting circuit to control the operation and non-operation thereof respectively by closing or opening of said switch means in response to a control signal; and control means having a first input connected to said input terminals, a second input connected to said temporary memory means, and an output connected to said means to generate said control signal having a predetermined limited duration in response to the application of the alternating voltage to the input terminals when the memory means changes from the second state to the first state and to delay generation of said control signal after a limited power cut at the input terminals to prevent starting pulses to be generated before the end of a predetermined time delay following the interruption of the alternating voltage.

Thus, the generation of starting pulses is controlled in response to the application of the alternating voltage to the input terminals of the lamp circuit at the beginning of a working period of the lighting installation and is limited to a predetermined duration.

If the lamp extinguishes due to an increase of its working threshold voltage without interruption of the supply voltage, no starting pulses will be generated and this defective lamp will remain extinguished and be easily detectable.

If the lamp extinguishes due to an interruption of the supply voltage, the temporary memory means are effective to distinguish between a first application of the alternating supply voltage and a re-establishment of the supply voltage following a short power interruption, or "micro-cut". While, in the first case, the generation of the starting pulses can be controlled immediately or a short delay after the application of the supply voltage, in the second case, the generation of the starting pulses is delayed by a period preferably sufficient to allow the cooling of the lamp.

DETAILED DESCRIPTION OF THE DRAWINGS

Figure 1:
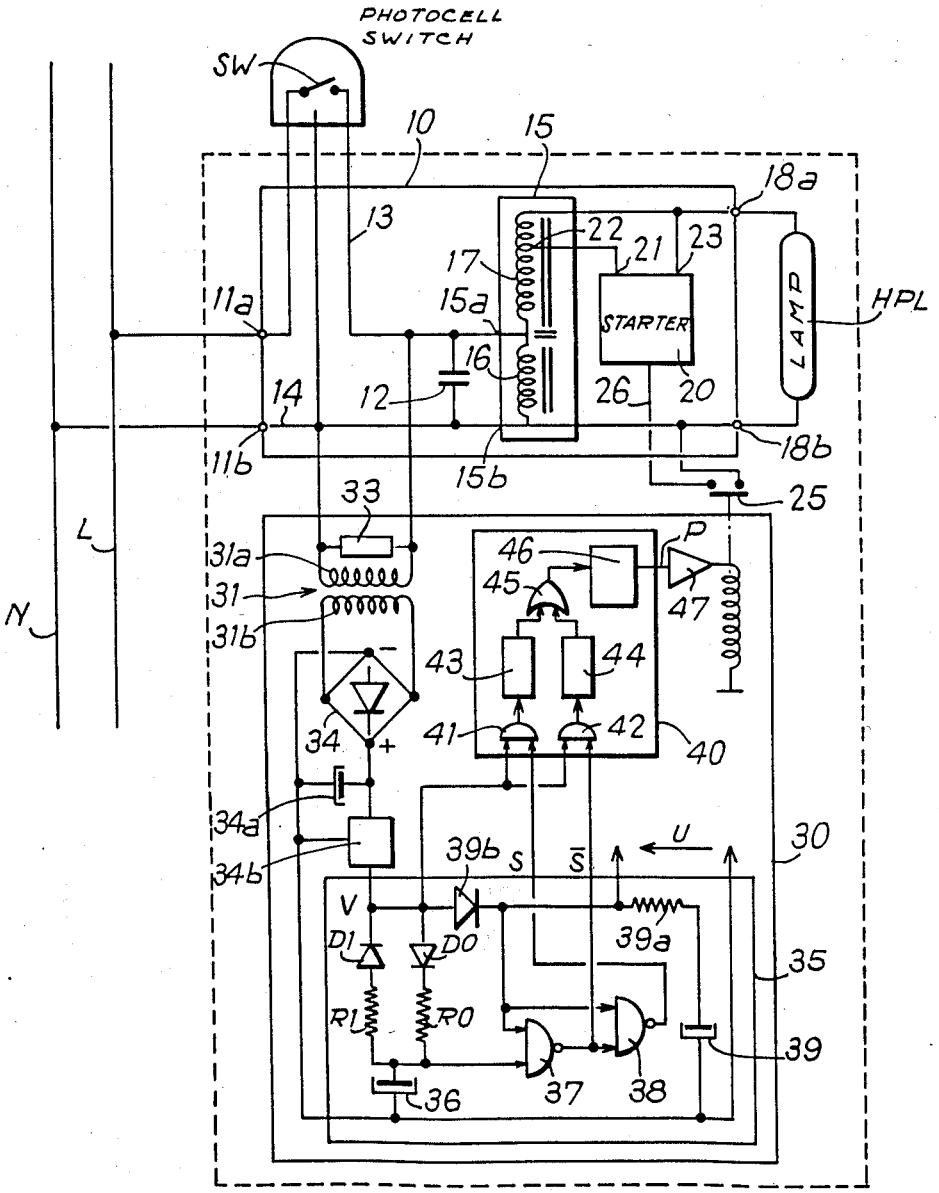
FIG. 1 is a schematic diagram of a lamp circuit incorporating a starting control circuit according to the invention.

Referring to FIG. 1, there is shown a circuit 10 for operating a high pressure discharge lamp HPL such as a high pressure sodium vapor lamp. Circuit 10 has first and second input terminals 11*a*, 11*b* connected to a source of alternating voltages through respective lines L,N. A switch SW controlled by a photocell is inserted into a conductor 13 connecting the input terminal 11*a* to an input 15*a* of a ballast circuit 15 while a conductor 14 connects the input terminal 11*b* to another input 15*b* of the ballast circuit 15. Said ballast circuit comprises a primary winding 16 connected in parallel with a capacitor 12 between the input terminals 15*a*, 15*b* and a secondary winding 17 serially connected between the input terminal 15*a* and an output terminal 18*a* of circuit 10. Lamp HPL is connected between the output terminal 18*a* and a second output terminal 18*b* of circuit 10 which is common with the reference potential terminals 15*b* and 11*b*.

A starting circuit 20 has an input 21 connected to a tap 22 provided on the ballast winding 17 and an output 23 connected to the output terminal 18*a* to supply the lamp HPL with starting pulses.

The above described structure of an HP lamp operating circuit is a conventional one and does not need to be explained in more detail. This circuit is housed in a lantern carrying the photocell controlled switch SW to allow an independent control of the operation of the lamp HPL as a function of the darkness.

According to the present invention, a starting control circuit 30 is provided to control the operation of the starting circuit 20 by opening or closing a controllable switch 25 which can be inserted in a conductor 26 connecting the starting circuit 20 to the reference potential terminal 11*b*.

The starting control circuit 30 has an input transformer 31 with a primary winding 31*a* connected between terminals 15*a*, 15*b* in parallel with a protective resistor 33 and a secondary winding 31*b* supplying voltage to a rectifying circuit 34 including a bridge of diodes 34, a capacitor 34*a* and, eventually, a voltage regulator 34*b*.

The rectified voltage V at the output of the rectifying circuit is applied to a temporary memory means 35 of which the output signal changes from a low state (L) to a high state (H) in response to the application of the rectified voltage V and remains in the high state (H) during a predetermined time period T1 before returning to the low state (L) after interruption of said rectified voltage V. Memory means 35 includes a capacitor 36 which is charged in response to the application of voltage V and discharges after interruption of voltage V. The charge voltage of the capacitor 36 is applied to a Schmidt trigger circuit 37 of which the output is inverted by means of a further Schmidt trigger circuit 38 acting as an inverter. The output signal of the inventer 38 constitutes the signal S which changes from the low level (L) to the high level (H) when the charge voltage of capacitor 36 exceeds a threshold value V0 and returns to the low level (L) when said charge voltage falls under the threshold value V0.

The variations of the rectified voltage V, of the charge voltage of capacitor 36, of the output S of the memory means 35, and of reverse $\bar{S}$ of signal S are illustrated in FIGS. 2*a*, 2*b*, 2*c* and 2*d* respectively. The time delay T0 between the time t0 of application of the voltage V and the passage of the output level of the memory means 35 from (L) to (H) is a function of the time constant of the charge circuit of capacitor 36, said charge circuit being constituted by a diode D0 and a resistor R0. Similarly, the time delay T1 between the time t1 of interruption of the voltage V and the passage of the output level of the memory means 35 from (H) to (L) can be predetermined by adjusting the time constant of the discharge circuit of capacitor 36, said discharge circuit being formed by a diode D1 and a resistor R1.

Figures 2A, 2B, 2C, 2D, 2E, 2F, 2G:
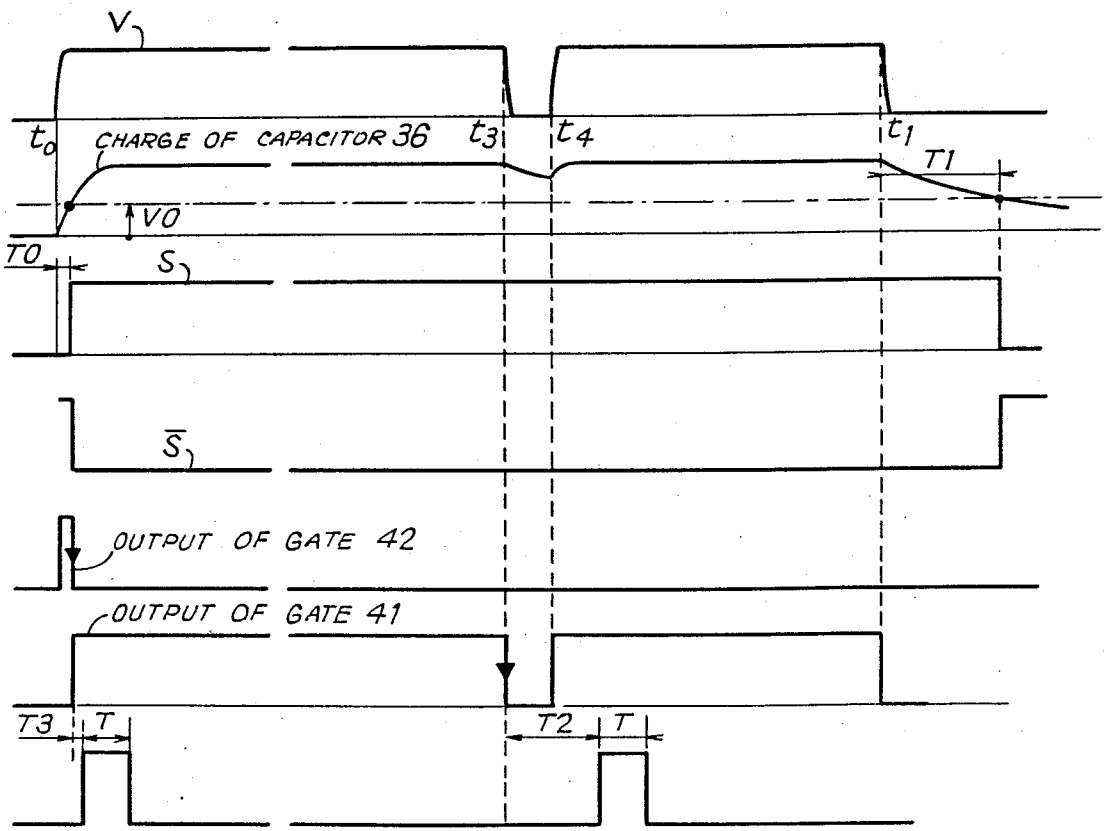
FIGS. 2*a* to 2*f* are timing diagrams illustrating various voltage waveforms in the circuit of FIG. 1.
FIG. 2*g* shows the control signal P for switch 25.

A control circuit 40 has a first input connected to the rectifying circuit for receiving voltage V and a second input connected to the memory means 35 for receiving the output signal S thereof. Control circuit 40 is designed to generate a control signal P for closing switch 25 during a predetermined time period T with a time delay from the detection of voltage V which is a function of the level of signal S. Circuit 40 comprises for example a first AND gate 41, having a first input receiving voltage V and a second input receiving signal S, and a second AND gate 42 having a first input receiving signal V and a second input connected at the output of the trigger circuit 37 to receive the reverse $\bar{S}$ of signal S. Delay circuits 43, 44 are connected to the outputs of gates 41, 42 to delay the output signals thereof respectively by predetermined time periods T2, T3. An OR gate 45 has two inputs respectively connected to the outputs of delay circuits T2, T3 and an output controlling a monostable circuit 46 which generates a pulse of predetermined duration T in response to the charge of the output of gate 45 from the low level (L) to the high level (H). The output pulse of circuit 46 constitutes the control signal P of switch 25 (FIG. 2*g*). In the example shown, the output signal of circuit 46 is amplified by circuit 47 and constitutes the energization signal of the coil of a relay forming switch 25.

The supply voltage U for the logic circuit elements of circuits 35 and 40 is available between the terminals of a series circuit including a capacitor 39 and a resistor 39*a*. Capacitor 39 is charged by voltage V through a return blocking diode 39*b* and resistor 39*a*, and forms an energy storage means to enable the voltage U to be available at least during said time period T1 following the interruption of voltage V.

The operation of the above described circuit will now be explained.

Upon closing of switch SW at time t0, the output of AND gate 42 changes from (L) to (H) (FIG. 2*e*) and returns to (L) after a time duration T0, causing the monostable circuit 46 to generate a control pulse P with a time delay T3 following the falling edge of the output of gate 42. The starting circuit is allowed to operate during the duration T of the pulse P to provide the lamp HPL with starting pulses. The initial time delay may have a duration T3 of a few seconds, for example about 2 s. The duration T of the control signal is selected to ensure that lamp HPL will be set into operation if it is not defective; for instance T may be approximately equal to 15 s. The time constant of the charge circuit of capacitor 36 and the duration T3 are preferably selected such that T3 be longer than T0, whereby no charge of the output level of the OR gate 45 will occur until the voltage V disappears. For example, the resistance of resistor R0 and the capacitance of capacitor 36 are respectively equal to 6.8 kΩ and 68 μF while delay circuit 44 is formed by a 4047 type CMOS monostable circuit having resistance capacitance values set to 1MΩ and 1 μF.

By allowing the starting circuit 20 to operate only for a limited time period after closing of switch SW, the "cycling" phenomenon is prevented and a defective lamp having extinguished will not be started again due to the disabling of the starting circuit.

Supposing now that the alternating voltage supplied by lines L, N is incidentally interrupted at time t3 for a small duration (micro-cut or power outage) shorter than T1, the output of AND gate 41 changes from (H) to (L) at time t3 and returns to (H) at the time t4 when the supply of alternating voltage is reestablished (FIG. 2*f*), causing the monostable circuit 46 to generate the control pulse P with a time delay T2 following the falling edge of the output of gate 41. This time delay T2 is selected to be sufficient to allow the cooling of the lamp which has extinguished at t3; for example, T2 is approximately equal to 145 s, the delay circuit 43 being formed for example by a 4047 type (MOS monostable circuit having resistance and capacitance values set to 1.2MΩ and 47 μF. The time period T1 during which the output of the memory means 25 remains at the high level (H) is chosen to have a duration substantially at least equal to the cooling period T2. Otherwise, if the time duration T1 is chosen shorter than T2, a control pulse P could be generated to re-start the lamp before the end of the cooling period in the case where the interruption of the alternating voltage lasts more than T1 but less than T2. The setting of T1 at a value higher than the above indicated value of T2 can be realized by choosing a resistor R1 and a capacitor 36 having a resistance of 10 ΩM and a capacitance of 68 μF respectively. If the interruption of the supply voltage lasts more than T1, the circuit operates at the end of this interruption as at time t0, the lamp having then cooled.

In summary, the starting control circuit according to the invention will only allow the generation of starting pulses either immediately after or a short time after closing of switch SW, or after a cooling period following a micro-cut in the supply of alternating voltage from the mains, avoiding continuous attempts to start defective lamps.

It will be noted that the control circuit according to the invention can be very easily adapted to existing installations because the only modification needed consists in the insertion of switch 25 into the conductor connecting the starting circuit 20 to the reference potential terminal.

What is claimed is:

1. In a high pressure lamp circuit comprising first and second input terminals for connection to a source of alternating voltage, third and fourth terminals for connection to a high pressure lamp, ballast means connected between said input terminals and said output terminals, and a starting circuit connected to said output terminals for generating starting signals for the lamp, the improvement consisting in a starting control circuit comprising:

memory means having a first state or a second state and connected to said input terminals to be changed from said second state to said first state in response to the application of said alternating voltage at said input terminals and to remain in said first state during a predetermined time period after interruption of said alternating voltage at the input terminals, before returning to said second state;

controllable switch means connected to said starting circuit to control the operation and non-operation thereof respectively by closing or opening of said switch means in response to a control signal; and control means having a first input connected to said input terminals, a second input connected to said temporary memory means, and an output connected to said switch means to generate said control signal having a predetermined limited duration in response to the application of the alternating voltage to the input terminals when the memory means changes from the second state to the first state and to delay the generation of said control signal after a limited power cut at the input terminals to prevent starting pulses to be generated before the end of a predetermined time delay following the interruption of the alternating voltage.

2. A starting control circuit as claimed in claim 1, wherein said switch means are inserted into a conductor connecting said starting circuit to a reference potential terminal.

3. A starting control circuit as claimed in claim 1, wherein said predetermined time delay is selected to be longer than a lamp cooling period.

4. A starting control circuit as claimed in claim 1, wherein said predetermined time period is substantially at least equal to said predetermined time delay.

* * * * *